US005672076A

United States Patent [19]

Inaba et al.

[11] Patent Number: 5,672,076

[45] Date of Patent: Sep. 30, 1997

[54] SHIELDED CONNECTOR

[75] Inventors: Shigemitsu Inaba; Hisaharu Katoh, both of Shizuoka, Japan

[73] Assignee: Yazaki Corporation, Tokyo, Japan

[21] Appl. No.: 784,311

[22] Filed: Jan. 16, 1997

Related U.S. Application Data

[63] Continuation of Ser. No. 383,226, Feb. 3, 1995, abandoned.

[30] Foreign Application Priority Data

Feb. 3, 1994 [JP] Japan ..... 6-011769

[51] Int. Cl.[6] ..... H01R 9/03

[52] U.S. Cl. ..... 439/610; 439/587

[58] Field of Search ..... 439/586, 587, 439/589, 598, 604, 607, 609, 610

[56] References Cited

U.S. PATENT DOCUMENTS

| | | | |
|---|---|---|---|
| 5,088,932 | 2/1992 | Nakamura | 439/610 X |
| 5,158,485 | 10/1992 | Saito et al. | 439/843 |
| 5,186,664 | 2/1993 | Abe | 439/845 |
| 5,226,842 | 7/1993 | Endo et al. | 439/843 |
| 5,338,227 | 8/1994 | Nakamura | 439/607 |
| 5,456,618 | 10/1995 | Nakamura | 439/607 X |

FOREIGN PATENT DOCUMENTS 58-178973 10/1983 Japan .

*Primary Examiner*—Khiem Nguyen

*Attorney, Agent, or Firm*—Sughrue, Mion, Zinn, Macpeak and Seas

[57] ABSTRACT

A shielded connector is so designed that its inner housing can be used independently, and the core wires of a shielded cable can be directly connected to the inner housing which has been shielded. A female inner connector and a male inner connector, in which terminals are accommodated respectively, are so designed as to be used independently. A female outer housing which is electrically conductive and connected to the shielding braid of a shielded cable is detachably preset over the female inner connector. A male outer housing which is electrically conductive and is connected to the shielding braid of a shielded cable is detachably preset over the male inner connector so that the male outer housing is fixedly coupled to the female outer housing through electrically conductive fixing means with the former electrically connected to the latter.

4 Claims, 3 Drawing Sheets

SHIELDED CONNECTOR

This is a continuation of application Ser. No. 08/383,226 filed Feb. 3, 1995 now abandoned.

BACKGROUND OF THE INVENTION

This invention relates to a shielded connector having an electromagnetic-shielding electrically conductive cover in such a manner that the latter is detachably engaged with the former.

A shielded connector is covered with an electrically conductive cover to shield the internal conductors (or terminals) from external electro-magnetic fields so that it is free from electromagnetic wave obstruction. An example of a shielded connector of this type which is made up of an inner housing and an outer housing, namely, an electrically conductive cover, will be described with reference to FIG. 8, which has been disclosed, for instance, by Japanese Patent Application (OPI) No. 178973/1983 (the term "OPI" as used herein means an "unexamined application").

An inner housing 1 of resin or the like has terminal accommodating chambers 3 which accommodate terminals (not shown) connected to the insulated core wires (hereinafter referred to merely as "core wires", when applicable) of a shielded cable 5. The insulating cover of one end portion of the shielded cable 5 is removed to a suitable length so that the shielding braid 9 is exposed, and the core wires 7 are spread outside.

The inner housing 1 is covered with outer housings 11*a* and 11*b*. The outer housings 11*a* and 11*b* have holding means 13 on their inner surfaces to hold the inner housing 1. Furthermore, the outer housings 11*a* and 11*b* have braid holders 15 formed on their inner surfaces. The braid holders 15 are brought into close contact with the shielding braid 9 when the outer housings 11*a* and 11*b* are combined together. The inner surfaces of the outer housings 11*a* and 11*b* including the braid holders 15 are plated with electrically conductive material 17, thus providing an electrically conductive enclosure to cover the inner housing 1.

The shielded connector 1 thus constructed is assembled as follows: First, the terminals connected to the core wires 7 are inserted into the terminal accommodating chambers 3 of the inner housing 1, and then the inner housing 1 is covered with the outer housings 11*a* and 11*b*.

In the shielded connector thus assembled, the electrically conductive material 17 connected through the braid holders 15 to the shielding braid 9 covers the inner housing 1, so that the internal conductors are shielded from external electromagnetic fields, thus being free from electro-magnetic wave obstruction.

As is apparent from the above description, the conventional shielded connector 19 is used with the outer housings 11*a* and 11*b* mounted on the inner housing 1. Hence, for instance in the case where shielding is not required, it is desirable to use only the inner housing 1 of the shielded connector; however, it is impossible to do so. Therefore, in such a case, it is necessary to provide an inner connector which can be used independently. This means that different connectors must be manufactured each by a small number, which impedes reduction of the manufacturing cost.

Furthermore, the conventional shielded connector is disadvantageous in the following point: In the case of the conventional shielded connector, after the core wires are connected to the inner housing 1, the latter 1 is covered with the outer housings 11*a* and 11*b*. That is, the inner housing 1 can be covered with the outer housings 11*a* and 11*b* only after the cores wires have been connected to the inner housing 1; in other words, it is impossible to connect the core wires 7 to the inner housing 1 which has been covered with the outer housings 11*a* and 11*b*. This feature increases the number of assembling steps which are to be carried after the connection of the core wires.

SUMMARY OF THE INVENTION

In view of the foregoing, an object of the invention is to provide a shielded connector which is so designed that the inner housing can be used independently, and the core wires can be to the inner housing which has been shielded, whereby the shielded connector is increased in the range of application, and is reduced in the manufacturing cost and improved in assembling efficiency.

In order to achieve the foregoing and other objects of the invention, provided is a shielded connector which, according to the invention, comprises:

a female inner connector and a male inner connector which accommodate terminals and are fixedly coupled to each other through fixing means;

a female outer housing which is electrically conductive and is connected to the shielding braid of a shielded cable whose core wires are connected to the terminals, and which is detachably preset over the female inner connector; and a male outer housing which is electrically conductive and is connected to the shielding braid of a shielded cable whose core wires are connected to the terminals, and which is detachably preset over the female inner connector, the male outer housing being fixedly coupled to the female outer housing through electrically conductive fixing means in such a manner that the male outer housing is electrically connected to the female outer housing.

In the shielded connector thus constructed, the female inner connector and the male inner connector include core-wire inserting portions, respectively, each of the core-wire inserting portions having a first rear holder accommodating chamber on the core-wire lead-out side thereof, in each of the core-wire inserting portions, a water-proofing plug of elastic material is mounted on the core wire to water-tightly close the gap between the inner cylindrical surface of the core-wire inserting portion and the core wire, and a first rear holder is fitted in the first rear holder accommodating chamber; while the female outer housing and the male outer housing include shielded-cable inserting portions, respectively, each of the shielded-cable inserting portions including a protrusion against which the shielding braid is abutted, and having a second rear holder accommodating chamber on the shielded-cable lead-out side thereof, and in each of the shielded-cable inserting portions, a water-proofing plug of elastic material is mounted on the shielded cable to water-tightly close the gap between the inner cylindrical surface of the shielded-cable inserting portion and the shielded cable, and a second rear holder is fitted in the second rear holder accommodating chamber in such a manner that the second rear holder pushes the water-proofing plug thereby to push the shielding braid against the protrusion with the aid of the elastic force of the water-proofing plug.

In the shielded connector of the invention, the female inner connector and the male inner connector can be used independently, and the female outer housing and the male outer housing are detachably engaged with the female inner connector and the male inner connector, respectively, in such a manner that they cover those inner connectors. Hence, in the case where shielding is unnecessary, the female inner connector and the male inner connector can be used without the female and male outer housings. In using the shielded connector where shielding is necessary, before the terminals are connected to the female inner connector and the male connector, the female outer housing and the male outer housing can be preset over the female inner connector and the male inner connector, respectively.

DESCRIPTION OF THE PREFERRED EMBODIMENTS

A shielded connector, which constitutes a preferred embodiment of the invention, will be described with reference to the accompanying drawings in detail.

Figure 1:
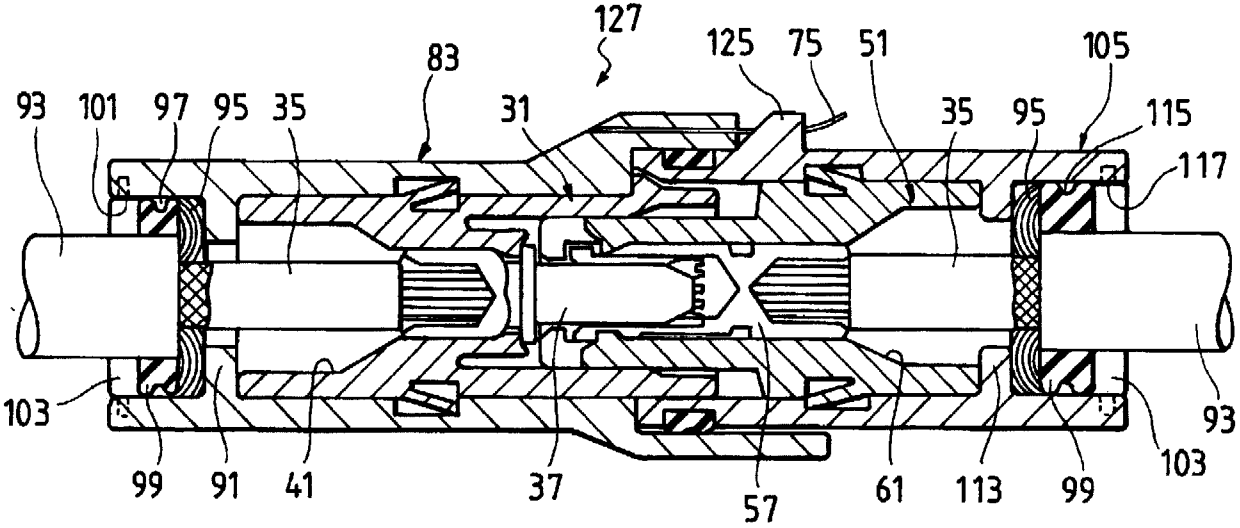
FIG. 1 is a sectional view of a shielded connector according to the invention in which outer housings are engaged with inner connectors.
Figure 2:
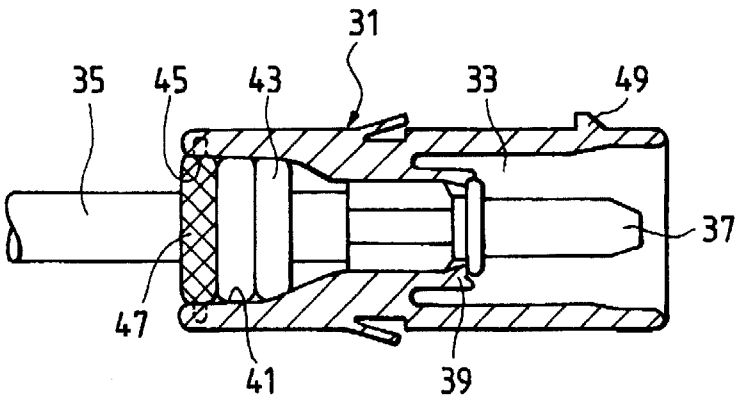
FIG. 2 is a sectional view of a female inner connector.
Figure 3:
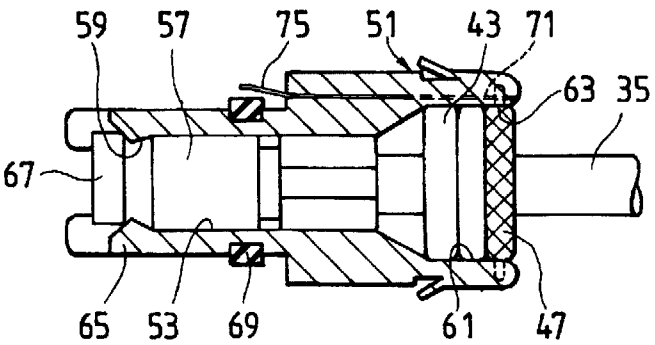
FIG. 3 is a sectional view of a male inner connector.
Figure 4:
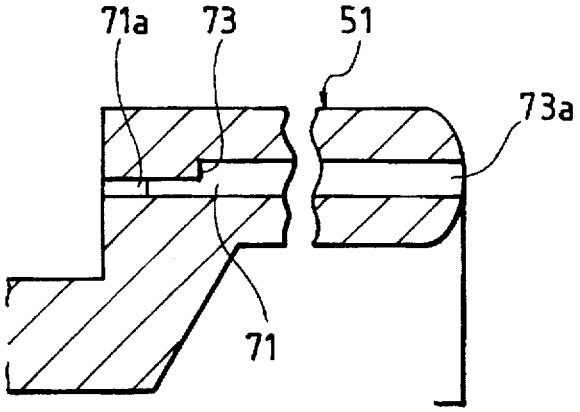
FIG. 4 is a sectional view of a lock plate fixing portion.
Figure 5:
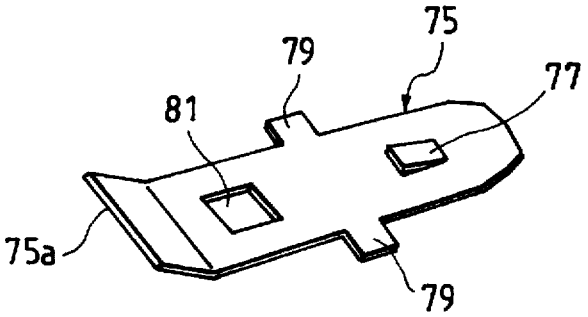
FIG. 5 is a perspective view of a lock plate.

FIG. 1 is a sectional view of the shielded connector with outer housing mounted over inner connectors. FIGS. 2 and 3 are sectional views of a female inner connector and a male inner connector, respectively, which correspond to the inner housing of the conventional shielded connector. FIG. 4 is a sectional view of a lock plate fixing portion. FIG. 5 is a perspective view of a lock plate.

As shown in FIG. 2, terminal accommodating chambers 33 are formed in a female inner connector 31 of insulating resin material. Those chambers 33 accommodate male terminals 37 connected to core wires 35, respectively. The female inner connector 31 has locking means, namely, flexible locking pieces 39 which are protruded inside the terminal accommodating chambers 33, to fixedly hold the male terminals 37 in the chambers 33 so that they may not come off. The rear end portion of the female inner connector 31 is formed into core-wire inserting portions 41. The core wires 35 connected to the male terminals 37 are extended through the core-wire inserting portions 41 backwardly of the female inner connector 31.

Annular water-proofing plugs 43 of rubber are mounted on each core wire 35 inserted into the core-wire inserting portion 41 in such a manner that the outer cylindrical surfaces of the plugs 43 are in close contact with the inner cylindrical surface of the core-wire inserting portion 41. That is, in the female inner connector 31, the gap between the core wire 35 and the inner cylindrical surface of the core-wire inserting portion 41 is water-tightly sealed with the water-proofing plugs 43. A first rear holder accommodating chamber 45 is formed in the core-wire inserting portion 41 at the rear end, so as to hold a first rear holder 47 in it. That is, the first rear holder 47 set in the first rear holder accommodating chamber 45 functions to prevent the water-proofing plugs 43 from coming off the core-wire inserting portion 41. The female inner connector 31 has a protrusion 49 on its front end portion, which is engaged with a lock plate secured to a male inner connector (described later).

As shown in FIG. 3, a male inner connector 51 has terminal accommodating chambers 53, which accommodate female terminals 57 which are connected to core wires 35. Locking means, namely, flexible locking pieces 59 are protruded inside each of the terminal accommodating chambers 53, to fixedly hold the female terminals 57 so that they may not come off the terminal accommodating chambers 53. The male inner connector 51 has core-wire inserting portions 61 at the rear end. The core wires 35 connected to the female terminals 57 are extended through the core-wire inserting portions 61 backwardly of the male inner connector 51.

Similarly as in the case of the above-described female inner connector 31, water-proofing plugs 43 are mounted on each of the core wires 35 inserted in the core-wire inserting portions 61 of the male inner connector 51 in such a manner the outer cylindrical surfaces of the plugs 43 are in close contact with the inner cylindrical surface of the core-wire inserting portion 61; that is, the gap between the core wire 35 and the inner cylindrical surface of the core-wire inserting portion 61 is water-tightly sealed with the water-proofing plug. Each core-wire inserting portion 61 has a first rear holder accommodating chamber 63 at the rear end, in which a first rear holder 47 is fitted to prevent the water-proofing plugs 43 from coming off the core-wire accommodating portion 61.

The front end portion of the male inner connector 51 is formed into an engaging portion 65 which is engaged with the female inner connector 31. The engaging portion 65 has terminal inserting inlets 67 at the end into which the male terminals 37 are inserted. An annular packing 69 of rubber is fitted on the engaging portion 65, so that, when the female inner connector 31 is coupled to the male inner connector 51, its outer cylindrical surface is brought into close contact with the inner surface of the female inner connector 31, whereby the inner surface of the female inner connector 31 is joined water-tight with the outer surface of the male inner connector 51.

As shown in FIG. 4, the male inner connector 51 has a lock plate fixing hole 71 in its outer wall into which a piece of plate can be inserted. The lock plate fixing hole 71 is partially defined by a step-shaped lance locking portion 73. A lock plate (fixing means) 75 made of a metal plate as shown in FIG. 5 is inserted into the lock plate fixing hole 71. The lock plate 75 has a lance 77 which is obtained, for instance, by cutting and raising a central portion of the lock plate 75. The lock plate 75 has insertion-stopping ears 79 extended from both opposite edges. When the lock plate 75 is inserted into the lock-plate fixing hole 71, those ears 79 are abutted against a widened portion 71*a* formed at the opening of the lock plate fixing hole 71, so that the lock plate 75 is inserted to a predetermined depth and positioned there. That is, when the insertion stopping ears 79 are abutted against the widened portion 71*a* while the lance 77 is locked by the lance locking portion 73, the lock plate 75 is fixedly engaged with the lock-plate fixing hole 71.

The lock plate 75 has an engaging hole 81 in its left half as viewed in FIG. 5 which is opposite to the right half in which the lance 77 is formed. The engaging hole 81 is engaged with the aforementioned protrusion 49 of the female inner connector 31. That is, the female inner connector 31 is fixedly coupled to the male inner connector 51 through the lock plate 75. The lock plate 75 can be readily disengaged from the protrusion 49 by bending the end portion 75*a* of the lock plate 75 in such a manner that the end portion 75*a* goes away from the protrusion 49.

When necessary, the lock plate 75 fixedly engaged with the lock-plate fixing hole 71 can be removed from the latter as follows: In this connection, it should be noted that the lance locking portion 73 is in the form of a through-hole. A jig is inserted into the through-hole through the outer end 73*a* to push back the lance 77 to unlock the latter 77. Thus, the lock plate 75 can be readily removed from the lock-plate fixing hole 71.

As is apparent from the above description, when the female inner connector 31 and the male inner connector 51 are coupled to each other, they are water-proofed and fixedly coupled to each other. Hence, those inner connectors 31 and 51 thus coupled can be used independently, without outer housings.

Figure 6:
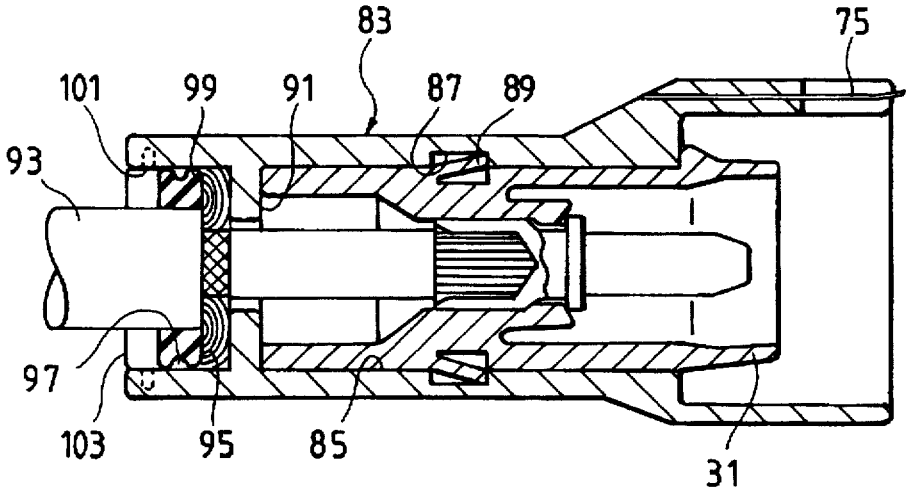
FIG. 6 is a female outer housing engaged with the female inner connector.
Figure 7:
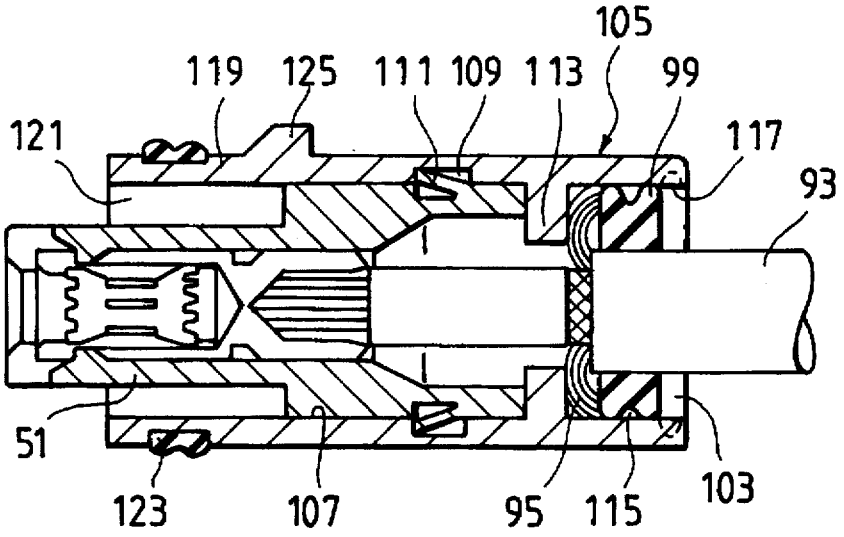
FIG. 7 is a male outer housing engaged with the male inner connector.
Figure 8:
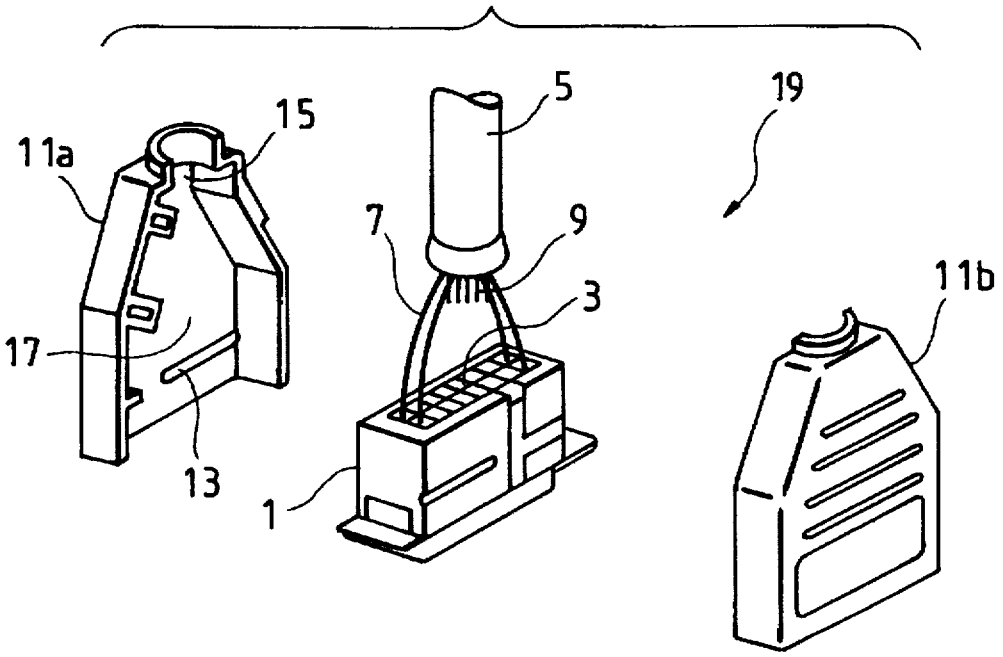
FIG. 8 PRIOR ART
FIG. 8 is an exploded perspective view of a conventional shielded connector.

The female inner connector 31 and the male inner connector 53 are detachably covered by outer housings so as to be shielded from external electromagnetic fields. The outer housings are made of electrically conductive resin, or outer housings of resin are employed which are entirely plated with electrically conductive material. FIG. 6 is a sectional view of a female outer housing 83 covering the female inner connector 31, and FIG. 7 is a sectional view of a male outer housing 105 covering the male inner connector 51.

As shown in FIG. 6, the female outer housing 83 has a connector accommodating chamber 85 in which the female inner connector 31 is accommodated. An outer lance locking recess 87 is formed in the inner surface of the connector accommodating chamber 85, which is engaged with outer lances 89 formed on the outer cylindrical surface of the female inner connector 31. The connector accommodating chamber 85 has a protrusion 91 at the rear end, the inner end face of which abuts against the rear end of the female inner connector 31. The shielding braid 95 of the shielded cable 93 is abutted against the outer end face of the protrusion 91 which is on the cable lead-out side. The rear end portion of the female outer housing 83, on the cable lead-out side of the protrusion 91, is formed into a shielded-cable inserting portion 97. The shielded cable 93 connected to the female inner connector 31 is led out of the female outer housing 83 through the shielded-cable inserting portion 97.

A water-proofing plug 99 of rubber is mounted on the shielded cable 93 extended through the shielded-cable inserting portion 97 in such a manner that it is held in close contact with the inner cylindrical surface of the shielded-cable inserting portion 97, thus water-tightly closing the gap between the shielded cable 93 and the inner cylindrical surface of the shielded-cable inserting portion 97. The shielded-cable inserting portion 97 has a second rear holder accommodating chamber 101 at the rear end, in which a second rear holder 103 is fitted. Hence, the second rear holder 103 fitted in the second rear holder accommodating chamber 101 prevents the water-proofing plug 99 from coming off the shielded-cable inserting portion 97. As the water-proofing plug 99 is pressed by the second rear holder, the shielding braid 95 is pushed against the inner cylindrical surface of the shielded-cable inserting portion 97 and the protrusion 91 by the elastic force of the water-proofing plug 99.

A lock plate fixing hole 71 similar to the above-described one (cf. FIG. 4) is formed in the outer wall of the female outer housing 83 so that, similarly as in the above-described case, a lock plate 75 is fixedly inserted into it.

As shown in FIG. 7, the male outer housing 105 has a connector accommodating chamber 107 in which the male inner connector 51 is accommodated. An outer lance locking recess 109 is formed in the inner cylindrical surface of the connector accommodating chamber 107, which is engaged with outer lances 11 formed on the outer cylindrical surface of the male inner connector 51. The connector accommodating chamber 107 has a protrusion 113 similar to the above-described protrusion 91. The rear end of the male inner connector 51 is abutted against the inner end face of the protrusion 113, and the shielding braid 95 of the shielded cable 93 is pushed against the outer end face of the protrusion 113 which is on the cable lead-out side. The rear end portion of the male outer housing 105, on the cable lead-out side of the protrusion 113, is formed into a shielded-cable inserting portion 115. The shielded cable 93 connected to the male inner connector 51 is led out of the female outer housing 105 through the shielded-cable inserting portion 115.

A water-proofing plug 99 of rubber is mounted on the shielded cable 93 extended through the shielded-cable inserting portion 115 in such a manner that it is held in close contact with the inner cylindrical surface of the shielded-cable inserting portion 115, thus water-tightly closing the gap between the shielded cable 93 and the inner cylindrical surface of the shielded-cable inserting portion 115. The shielded-cable inserting portion 115 has a second rear holder accommodating chamber 117 at the rear end, in which a second rear holder 103 is fitted. Hence, similarly as in the above-described case, the second rear holder 103 fitted in the second rear holder accommodating chamber 117 prevents the water-proofing plug 99 from coming off the shielded-cable inserting portion 115, and pushes the shielding braid 95 against the inner cylindrical surface of the shielded-cable inserting portion 115 and the protrusion 113 with the aid of the elastic force of the water-proofing plug 99.

The front end portion of the male outer housing 105 is formed into an engaging portion 119 which is inserted into the female outer housing 83. The engaging portion 119 has a connector inserting inlet 121 at the end into which the female inner connector 31 is inserted. An annular packing 123 of rubber is mounted on the engaging portion 119, which functions as follows: When the female outer housing 83 and the male outer housing 105 are engaged with each other, the outer cylindrical surface of the annular packing 123 is brought into close contact with the inner cylindrical surface of the female outer housing 83 to water-tightly close the gap between the inner cylindrical surface of the female outer housing 83 and the engaging portion 119 of the male outer housing 105.

A protrusion 125 is formed on the outer wall of the male outer housing 105, which is engaged with an engaging hole 81 formed in the lock plate 75 secured to the female outer housing 83. Hence, the female outer housing 83 is fixedly coupled to the male outer housing 105 through the lock plate 75.

As is apparent from the above description, roughly stated, the shielded connector 127 is made up of the female inner connector 31, the male inner connector 51, the lock plate 75, the female outer housing 83, and the male outer housing 105.

The shielded connector 127 thus constructed is used as follows: In the case where shielding is unnecessary, only the female inner connector 31 and the male inner connector 51 are used. In this case, the female inner connector 31 is fixedly coupled to the male inner connector 51 with the lock plate 75 inserted into the lock plate fixing hole 71 of the male inner connector 51.

On the other hand, in the case where shielding is necessary, first the lock plate 75 is removed from the male inner connector 51.

Next, the female inner connector 31 is inserted into the female outer housing 83 through the front end, and the male inner connector 51 is inserted into the male outer housing 105 through the front end. Under this condition, the lock plate 75 is fixedly inserted into the lock plate fixing hole 71 of the female outer housing 83.

Thereafter, the male terminals 37 connected to the core wires 35 are inserted into the female inner connector 31 through the rear end which has been set in the female outer housing 83 in the above-described manner. In this operation, the shielding braid 95 of the shielded cable 93 is pushed against the protrusion 91 of the female outer housing 83. Similarly, the female terminals 57 connected to the cores wires 35 are inserted into the male inner connector 51 through the rear end which has been set in the male outer housing 105 in the above-described manner. In this operation, too, the shielding braid 95 of the shielded cable 93 is pushed against the protrusion 113 of the male outer housing 105.

Next, the second rear holders 103 are fitted in the second rear holder accommodating chambers 101 and 117, respectively, so that the shielding braids 95 and 95 are pushed against the inner end faces of the shielded-cable inserting portions 97 and 115 with the aid of the elastic forces of the water-proofing plugs 99 and 99, respectively. Thus, the male and female parts of the shielded connector 127 have been assembled.

Thereafter, the male outer housing 105 is inserted into the female outer housing 83 until the locking hole 81 of the lock plate 75 is engaged with the protrusion 125; that is, the male outer housing 105 is fixedly coupled to the female outer housing 83 through the lock plate 75. When the male outer housing 105 is coupled to the female outer housing 83 in this manner, the former 105 is electrically connected to the latter 83 through the lock plate 75.

The provision of the shielded connector 127 thus constructed has achieved the object of the invention; that is, the female and male inner connectors 31 and 51 can be used independently, and the assembling work can be achieved with high efficiency. In addition, in the shielded connector 127 of the invention, the female outer housing 83 and the male outer housing 105 are entirely plated, which eliminates the necessity for performing a masking process for selective plating; that is, the plating operation can be achieved with ease.

Furthermore, the shielding braids 95, being pushed against the outer housings by the elastic forces of the water-proofing plugs 99 under a predetermined load, are stably electrically connected thereto.

In the above-described embodiment, the fixing means, namely, the lock plate 75 is used to secure the female connector 31 to the male connector 52, or to secure the female outer housing 83 to the male outer housing 105; however, the invention is not limited thereto or thereby. That is, the shielded connector may be modified as follows: The lock plate 75 is eliminated, and instead lance-shaped fixing means for securing the female inner connector 31 and the male inner connector 51 to each other are formed on those inner connectors 31 and 51, while fixing means for securing the female outer housing 83 and the male outer housing 105 to each other are formed on those outer housings 83 and 105. In this modification, the female outer housing 83 is positively electrically connected to the male outer housing 105 through the fixing means.

As was described above, in the shielded connector of the invention, the female outer housing and the male outer housing, which are both electrically conductive, are detachably engaged with the female inner connector and the male inner connector, respectively, which can be used without the outer housings. Hence, the female inner connector and the male inner connector can be used not only in the case where shielding is required but also in the case where shielding is not required. This feature increases the range of application of the shielded connector, and reduces the manufacturing cost and enhances the assembling work. Furthermore, where shielding is necessary, the female outer housing and the male outer housing can be preset over the female inner connector and the male inner connector, respectively. Hence, the terminals can be directly connected to the inner connectors which have been engaged with the outer housings; in other words, no assembling work is required after the connection of the core wires. This greatly improves the assembling work of the shielded connector.

We claim:

1. A shielded connector which can be connected in an unshielded state, said connector comprising:

a female inner connector and a male inner connector which accommodate terminals;

a female outer housing which is electrically conductive and comprises means for connecting a shielding braid of a shielded cable, whose core wires are connected to the terminals of said female inner connector, to said female outer housing;

a male outer housing which is electrically conductive and comprises means for connecting another shielding braid of another shielded cable, whose core wires are connected to the terminals of said male inner connector, to said male outer housing; and electrically conductive fixing means for fixedly coupling said male outer housing to said female outer housing so that said male outer housing is electrically connected to said female outer housing and for fixedly coupling said male inner connector to said female inner connector in an unshielded state in which said male and female inner connectors are connected to each other without also fixedly coupling said male and female outer housings.

2. The shielded connector according to claim 1, wherein said fixing means includes a plate-like lock plate.

3. A shielded connector according to claim 1, wherein said female inner connector and said male inner connector include core-wire inserting portions, respectively, each of said core-wire inserting portions having a first rear holder accommodating chamber on the core-wire lead-out side thereof, and in each of said core-wire inserting portions, a water-proofing plug of elastic material is mounted on said core wire to water-tightly close the gap between the inner cylindrical surface of said core-wire inserting portion and said core wire, and a first rear holder is fitted in said first rear holder accommodating chamber; while said female outer housing and said male outer housing include shielded-cable inserting portions, respectively, each of said shielded-cable inserting portions including a protrusion against which said shielding braid is abutted, and having a second rear holder accommodating chamber on the shielded-cable lead-out side thereof, and in each of said shielded-cable inserting portions, a water-proofing plug of elastic material is mounted on said shielded cable to water-tightly close the gap between the inner cylindrical surface of said shielded-cable inserting portion and said shielded cable, and a second rear holder is fitted in said second rear holder accommodating chamber in such a manner that said second rear holder pushes said water-proofing plug thereby to push said shielding braid against said protrusion with the aid of the elastic force of said water-proofing plug.

4. A shielded connector comprising:

a female inner connector and a male inner connector which accommodate terminals;

a female outer housing which is electrically conductive and is connected to a shielding braid of a shielded cable whose core wires are connected to said terminals, and which is detachably preset over said female inner connector; and a male outer housing which is electrically conductive and is connected to a shielding braid of a shielded cable whose core wires are connected to said terminals, and which is detachably preset over said male inner connector, said male outer housing being fixedly coupled to said female outer housing through electrically conductive fixing means in such a manner that said male outer housing is electrically connected to said female outer housing, wherein said female inner connector and said male inner connector include core-wire inserting portions, respectively, each of said core-wire inserting portions having a first rear holder accommodating chamber on the core-wire lead-out side thereof, and in each of said core-wire inserting portions, a water-proofing plug of elastic material is mounted on said core wire to water-tightly close the gap between the inner cylindrical surface of said core-wire inserting portion and said core wire, and a first rear holder is fitted in said first rear holder accommodating chamber; while said female outer housing and said male outer housing include shielded-cable inserting portions, respectively, each of said shielded-cable inserting portions including a protrusion against which said shielding braid is abutted, and having a second rear holder accommodating chamber on the shielded-cable lead-out side thereof, and in each of said shielded-cable inserting portions, a water-proofing plug of elastic material is mounted on said shielded cable to water-tightly close the gap between the inner cylindrical surface of said shielded-cable inserting portion and said shielded cable, and a second rear holder is fitted in said second rear holder accommodating chamber in such a manner that said second rear holder pushes said water-proofing plug thereby to push said shielding braid against said protrusion with the aid of the elastic force of said water-proofing plug.

* * * * *